US007614821B2

(12) United States Patent
Stromsoe

(10) Patent No.: US 7,614,821 B2
(45) Date of Patent: Nov. 10, 2009

(54) IMPACT COMPACTOR

(75) Inventor: Roger Arnold Stromsoe, Bryanston (ZA)

(73) Assignee: Impact Compaction (Proprietary) Limited, Bultfontein, Lanseria (ZA)

( * ) Notice: Subject to any disclaimer, the term of this patent is extended or adjusted under 35 U.S.C. 154(b) by 33 days.

(21) Appl. No.: 10/567,247

(22) PCT Filed: Aug. 6, 2004

(86) PCT No.: PCT/IB2004/002534

§ 371 (c)(1),
(2), (4) Date: Feb. 20, 2007

(87) PCT Pub. No.: WO2005/014938

PCT Pub. Date: Feb. 17, 2005

(65) Prior Publication Data

US 2008/0008542 A1 Jan. 10, 2008

(30) Foreign Application Priority Data

Aug. 6, 2003 (ZA) ..... 2003/6072

(51) Int. Cl.
*E01C 19/05* (2006.01)

(52) U.S. Cl. ..... 404/85; 404/86; 404/126

(58) Field of Classification Search ..... 404/122, 404/185, 128, 85, 86, 126, 132, 133.05; 172/604, 452

See application file for complete search history.

(56) References Cited

U.S. PATENT DOCUMENTS 2,154,720 A * 4/1939 Biles ..... 172/63
2,386,025 A * 10/1945 Wills ..... 404/86
2,585,117 A * 2/1952 Gurries ..... 404/86
2,909,106 A * 10/1959 Berrange ..... 404/124
3,867,052 A 2/1975 Durham ..... 404/121
3,891,342 A * 6/1975 Roe ..... 404/128
3,966,346 A * 6/1976 Berrange ..... 404/124
3,993,413 A * 11/1976 Cox et al. ..... 404/128
4,044,839 A * 8/1977 van der Lely ..... 172/49.5
4,070,974 A * 1/1978 Stacy, Jr. ..... 111/169
4,100,688 A * 7/1978 Grist ..... 37/403
4,131,162 A * 12/1978 Schmitz ..... 172/138

(Continued)

FOREIGN PATENT DOCUMENTS

EP 0 017511 B1 2/1984

(Continued)

*Primary Examiner*—Gary S Hartmann
*Assistant Examiner*—Alina Schiller
(74) *Attorney, Agent, or Firm*—Woodcock Washburn LLP

(57) ABSTRACT

This invention relates to an impact compactor including a wheeled chassis structure and at least one non-round roller carried on an axle assembly. The axle assembly is rotatably mounted on a drag link, which is pivotally mounted on the chassis structure. The compactor includes also a lifting arrangement for lifting the roller from the ground, including a lifting arm, located above the drag link and pivotally displaceable with respect to the chassis structure, and a piston/cylinder mechanism for pivoting it. The lifting arm has a depending lifting formation that can releasably engage either one of the drag link and the axle assembly carried by the drag link for raising the roller from the ground. The configuration of the lifting arrangement provides for suitable accommodation of the piston/cylinder mechanism, which is problematic in some conventional-type compactors and associated with certain risks of mechanical failure during compaction operations.

7 Claims, 9 Drawing Sheets

U.S. PATENT DOCUMENTS

| | | | | | |
|---|---|---|---|---|---|
| 4,147,448 | A | * | 4/1979 | Jeffery | 404/124 |
| 4,278,368 | A | * | 7/1981 | Livesay | 404/117 |
| 4,610,567 | A | | 9/1986 | Hosking | 404/121 |
| 4,702,643 | A | * | 10/1987 | Thilmony | 404/121 |
| 4,911,248 | A | * | 3/1990 | Schrepfer | 172/464 |
| 4,950,102 | A | * | 8/1990 | Zeitz | 404/121 |
| 5,348,418 | A | * | 9/1994 | Campbell | 404/103 |
| 5,404,660 | A | * | 4/1995 | Webster | 37/189 |
| 5,562,365 | A | * | 10/1996 | Berrange | 405/271 |
| 6,354,761 | B1 | * | 3/2002 | Clements | 404/129 |
| 6,382,873 | B1 | * | 5/2002 | Mulders et al. | 404/128 |
| 7,334,964 | B1 | * | 2/2008 | Brown et al. | 404/126 |
| 7,410,323 | B1 | * | 8/2008 | Roth | 404/132 |

FOREIGN PATENT DOCUMENTS

| | | |
|---|---|---|
| WO | WO 99/60218 A1 | 11/1999 |

* cited by examiner

IMPACT COMPACTOR

FIELD OF THE TECHNOLOGY

THIS INVENTION relates to an impact compactor.

An impact compactor, also known as an impact roller, of the type herein envisaged, includes either a single non-round roller, or a pair of such rollers, rotatable on an axle assembly that is displaceably located on a wheeled chassis structure. The impact compactor either may be tractor towed for its use, or may be self-propelled.

In a common type of impact compactor including two non-round rollers, a mechanical link, commonly referred to as a drag link, pivotally mounted on its chassis structure, connects the axle assembly and the chassis structure in the required configuration in which the operative height of the axis of rotation defined by the axle assembly for the non-round rollers above ground level can vary, thereby accommodating displacement of the non-round rollers carried on the axle assembly along a ground surface being compacted, while the wheeled chassis travels along the said ground surface.

BACKGROUND

In order to facilitate displacement of an impact compactor, when not in use, a lifting arrangement thereof provides for the rollers to be lifted with respect to the chassis structure, as permitted by the drag link that carries the axle assembly of the non-round rollers, to a level at which the said rollers are lifted off the ground and the compactor is thus displaceable on its wheels only.

The lifting arrangement referred to comprises a piston/cylinder mechanism that is operable between the chassis structure and the drag link, usually via a lifting plate pivotally located with respect to the drag link and generally below the drag link. In the latter case, an upper end of the piston/cylinder mechanism is connected to the lifting plate to effect pivoting thereof whilst, because of mechanical constraints associated with the compactor, including the requirement for a piston/cylinder with a sufficient stroke for effecting the required raising and lowering of the rollers, the other end of the piston/cylinder mechanism is located at a level beneath the general plane of the chassis structure. In order to raise the rollers with respect to the chassis structure, the piston/cylinder mechanism is extended so that the lifting plate is pivoted upwards by it to bear on the underside of the drag link to raise it. When the piston/cylinder mechanism is in its fully retracted configuration, the rollers are supported on the ground and a clearance or spacing is provided between the drag link and the lifting plate, so that the drag link can pivot with respect to the chassis without interference by the lifting plate.

In practice, particularly when compacting soft ground, it sometimes occurs that the rollers penetrate the ground to an extent that the drag link impacts on the lifting plate. This may result in mechanical damage to the lifting arrangement, e.g. punching of the piston/cylinder mechanism through the drag link. In order to reduce the risk of such damage, the clearance referred to must be maximized. To achieve this, the compactor may have the mounting location of the piston/cylinder mechanism on the chassis structure at a low level. As such, ground clearance of the lower end of the piston/cylinder mechanism is minimized, increasing the risk of damage to it due to interference by an obstacle, e.g. a rock, on the ground. Furthermore, the piston/cylinder mechanism usually is not easily visible to an operator of the compactor and, due to operator error, the piston/cylinder mechanism may not be fully retracted during use of the compactor. As such, the clearance between the drag link and the lifting plate is reduced, increasing the risk of the type of mechanical damage referred to.

The risks of damage of the above general types also are present in other variants of impact compactors including at least one non-round roller and a lifting arrangement therefor and, clearly, are disadvantages associated with such compactors. Insofar as the general configuration of an impact compactor of this general type is well known, as are the disadvantages associated with the lifting arrangement thereof, these aspects are not described in further detail herein, although the description above may be further clarified with reference to an accompanying drawing, designated FIG. 1, and a description of the drawing below.

SUMMARY

It is an object of this invention to provide an improved impact compactor, particularly an impact compactor associated with a lifting arrangement in association with which the above disadvantages are eliminated.

Any reference hereinafter to an impact compactor must be interpreted as a reference to an impact compactor of the general type described above.

According to the invention there is provided an impact compactor, which includes

- a chassis structure having wheels for supporting the structure above the ground;
- a non-round roller carried on a axle assembly mounted on the chassis structure via a pivotally located drag link; and
- a lifting arrangement for lifting the location of the non-round roller with respect to the chassis structure to a raised level at which the roller is spaced above the ground on which the chassis structure is supported by its wheels, the lifting arrangement including a lifting arm, located above the drag link and having a depending lifting formation that can engage either one of the drag link and the axle assembly carried by the drag link, when displaced operatively upwardly, and a piston/cylinder mechanism operatively connected between the lifting arm and the chassis structure and being operable to displace the lifting arm between a first position, in which the lifting formation is spaced from the one of the drag link and the axle assembly to be engaged thereby, and a second position, in which the lifting formation is engaged with the one of the drag link and the axle assembly and the non-round roller is thereby raised with respect to the chassis structure to a level at which it is spaced above the ground on which the chassis structure is supported by its wheels.

The general configurations of the wheeled chassis structure, of the non-round rollers, and of the drag link, of the impact compactor of the invention, are conventional and, as such, are not defined in further detail herein.

The features of the impact compactor of the invention, particularly those of its lifting arrangement, makes it possible to, in practical embodiments, make the spacing between the lifting formation and the one of the drag link and the axle assembly to be engaged thereby, in the first position of the lifting arm, sufficiently large to eliminate the risk of mechanical damage of the type referred to above whilst providing sufficient ground clearance to the lower end of the piston/cylinder mechanism.

The depending lifting formation of the lifting arm of the lifting arrangement may be formed to engage the drag link via an engagement formation on the link. Alternatively, the depending lifting formation may be formed to engage the axle assembly via an engagement formation on the assembly.

The piston of the piston/cylinder mechanism may particularly have a stroke that provides for the required displacement of the lifting arm between its first and second positions, the first position of the lifting arm providing particularly for a space in between the depending lifting formation and the engagement formation to be engaged thereby, to permit operation of the compactor without mechanical interference by the lifting arrangement.

According to one particular embodiment of the invention, the depending lifting formation of the lifting arm may extend through a space provided therefor by the drag link. An alternative embodiment of the invention provides for the lifting arm to extend beyond and over or under the drag link and axle assembly, and then have a lifting formation extending to a location where it can engage the engagement formation provided therefor on either one of the drag link and the axle assembly.

The piston/cylinder mechanism forming part of the lifting arrangement may be hydraulically operable and its operation may be controllable by an operator of the compactor. The end of the piston/cylinder mechanism supported on the chassis structure may be pivotally supported via a formation provided therefor on the chassis structure, in the location of the general plane of the chassis structure.

The lifting arm of the lifting arrangement may be pivotally displaceable between its first and second positions. As such, the lifting arm may be pivotally supported on the drag link at a location near the pivotally located end of the drag link. Alternatively, the lifting arm may be pivotally supported on a component of the compactor other than the drag link. It may be pivotally supported on the component particularly at a position near the pivotally located end of the drag link. So, e.g., in the case of an impact compactor, in accordance with the invention, including a link, sometimes referred to as a drop link, on which the drag link is pivotally located, the lifting arm may be pivotally supported on this link, possibly via the same pivot pin carrying the drag link.

The end of the piston/cylinder mechanism connected to the lifting arm may be pivotally connected thereto at a location near the end of the lifting arm remote from the end thereof that is pivotally supported.

The impact compactor may be configured to be towed by a tractor for its operation. It may, alternatively, be self-propelled. Insofar as the features associated with the two forms of impact compactor of the above type are well known, these are not described in further detail herein.

The impact compactor may include a pair of non-round rollers, as defined. As such, both the axle assembly carried by the drag link and the lifting arrangement may be disposed between the rollers. Alternatively, the non-round roller may be a single roller. As such, the compactor may include a pair of lifting arrangements, as defined, disposed on opposite sides of the roller.

The mechanical construction of the impact compactor of the invention and particularly of the features associated with the lifting arrangement thereof, are greatly variable and the invention extends also to impact compactors incorporating such variations while still incorporating the essential features of the present invention.

BRIEF DESCRIPTION OF THE DRAWINGS

Further features of the impact compactor of the invention are described hereafter with reference to an example of an impact compactor, in accordance with the invention, illustrated in the accompanying diagrammatic drawings. In the drawings.

DETAILED DESCRIPTION

Figure 1:
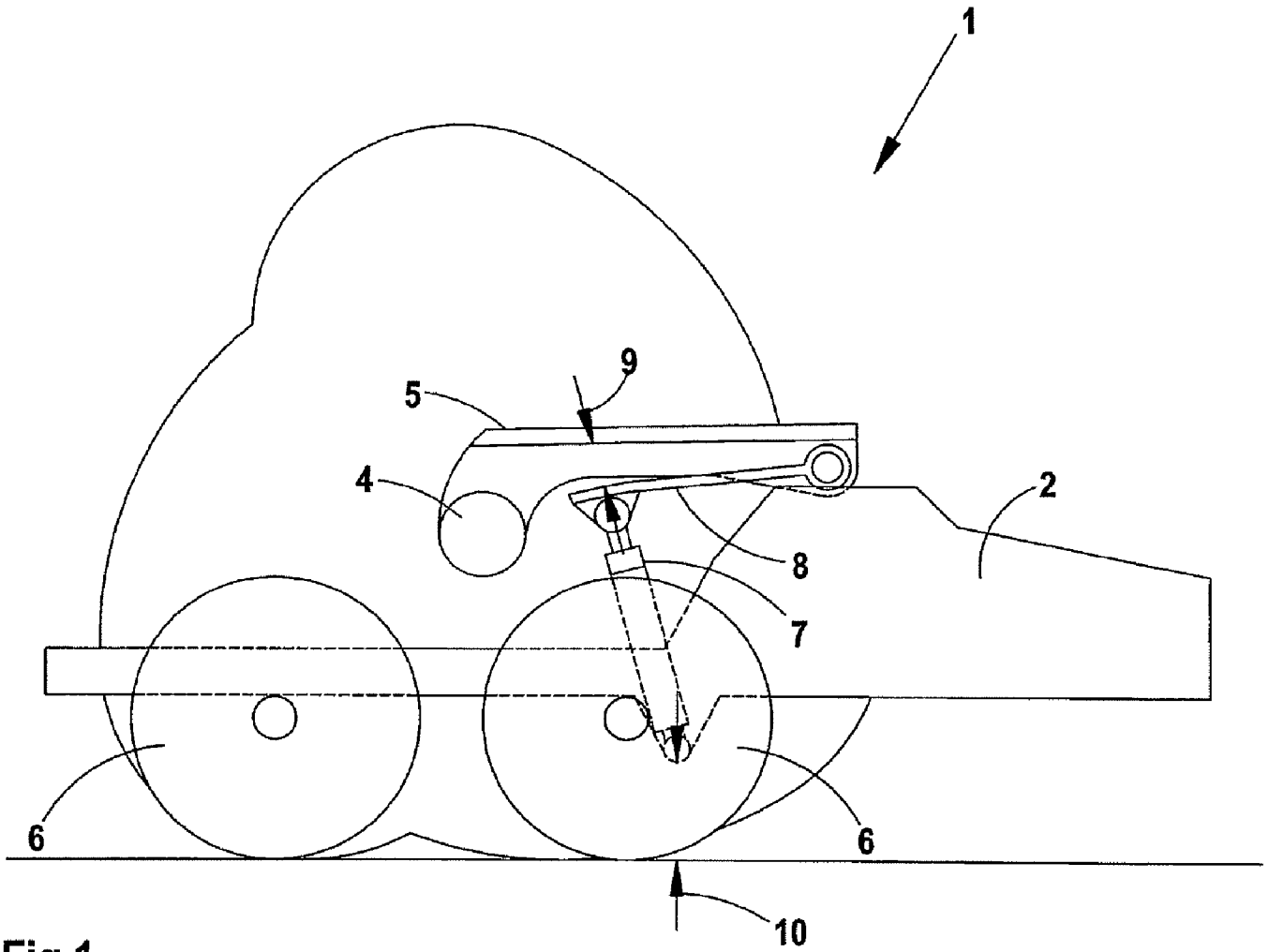
FIG. 1 shows a schematic side view of a prior art impact compactor, in its operative compactor configuration, having the near-side non-round roller omitted therefrom for the sake of clarity.
Figure 2:
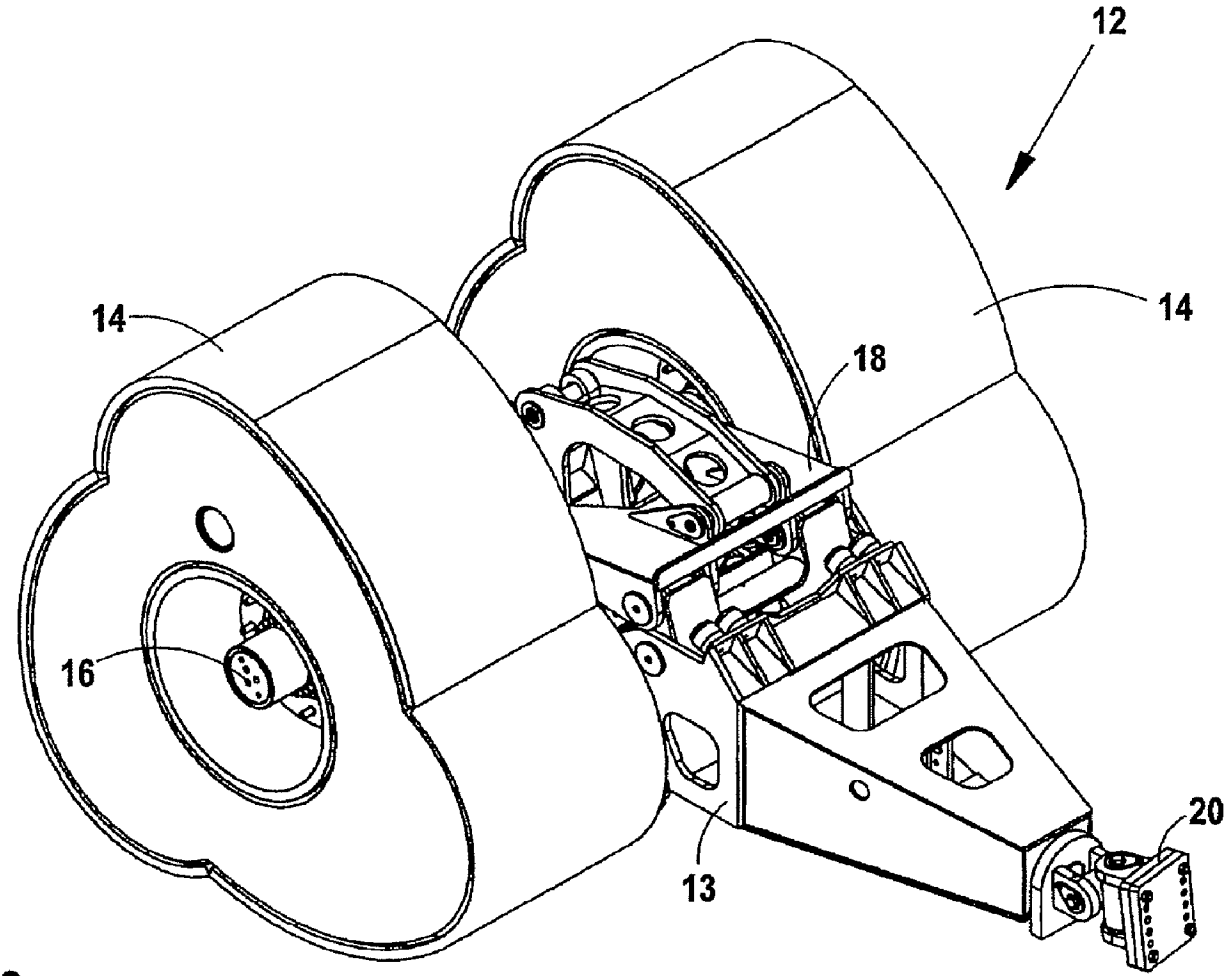
FIG. 2 shows a three-dimensional view of an impact compactor, in accordance with the invention, including two non-round rollers, in its operative compactor configuration.

In FIG. 1, a prior art or conventional-type impact compactor, to be towed by a tractor, is designated generally by the reference numeral 1. The compactor 1 includes a chassis structure 2 and two non-round rollers 3 (only one shown), interconnected via an axle assembly 4. The axle assembly 4 is carried on one end of a drag link 5, pivotally mounted at its other end on the chassis structure 2.

The chassis structure 2 is supported on the ground via four wheels 6 (only two shown).

The compactor 1 includes also a hydraulic piston/cylinder mechanism 7 and a lifting plate 8. The lifting plate 8 is disposed generally below the drag link 5 and pivotally mounted, at one end thereof, on the chassis structure 2. At its other end, it is pivotally connected to an upper end of the mechanism 7 which, in turn, is pivotally mounted at its lower end on the chassis structure 2 at a location below the general plane of the chassis structure.

Disadvantages associated with an impact compactor such as the impact compactor 1 were described above. In this description, reference was made to the spacing between the drag link and the lifting plate of an impact compactor, in the fully retracted configuration of its piston/cylinder mechanism, and for the compactor 1, this spacing is designated generally by the reference numeral 9. Reference was also made to the ground clearance of the lower end of the piston/cylinder mechanism of an impact compactor, and for the compactor 1, this clearance is designated by the reference numeral 10.

Referring to FIGS. 2 to 7, an impact compactor, in accordance with the invention, is designated generally by the reference numeral 12. The impact compactor 12 essentially is of a conventional type that is to be towed by a tractor for the operation thereof and, as such, includes certain features equivalent to those of the compactor 1 of FIG. 1. As such, it particularly includes a wheeled chassis structure 13 on which two non-round rollers 14 are displaceably supported via an axle assembly 16 and a drag link 18.

The drag link 18 is pivotally supported on the chassis structure 13, particularly via a link arrangement (not clearly shown), the main link of this arrangement being referred to hereafter as the drop link. The chassis structure 13 also has a coupling formation 20 associated therewith for coupling the impact compactor 12 to a tractor.

Insofar as the overall construction of the impact compactor 12 is conventional, as is the operation thereof, these aspects of the impact compactor 12 are not described in further detail herein.

As is clearly illustrated in the figures that have the near side non-round roller 14 thereof omitted for the sake of clarity, the chassis structure 13 of the impact compactor 12 also has two pairs of wheels 22 and 24, respectively, rotatably carried thereon, the wheels 22 and 24 providing for the displacement of the impact compactor 12 along a ground surface when towed by a tractor, both while in use and while not in use.

In order to facilitate the displacement of the impact compactor 12 while not in use, a lifting arrangement, generally designated by the numeral 26, is provided for displacing the non-round rollers 14 with respect to the chassis structure 13 to a raised position at which they are spaced above the ground surface on which the wheels 22 and 24 are displaceable.

Figure 3:
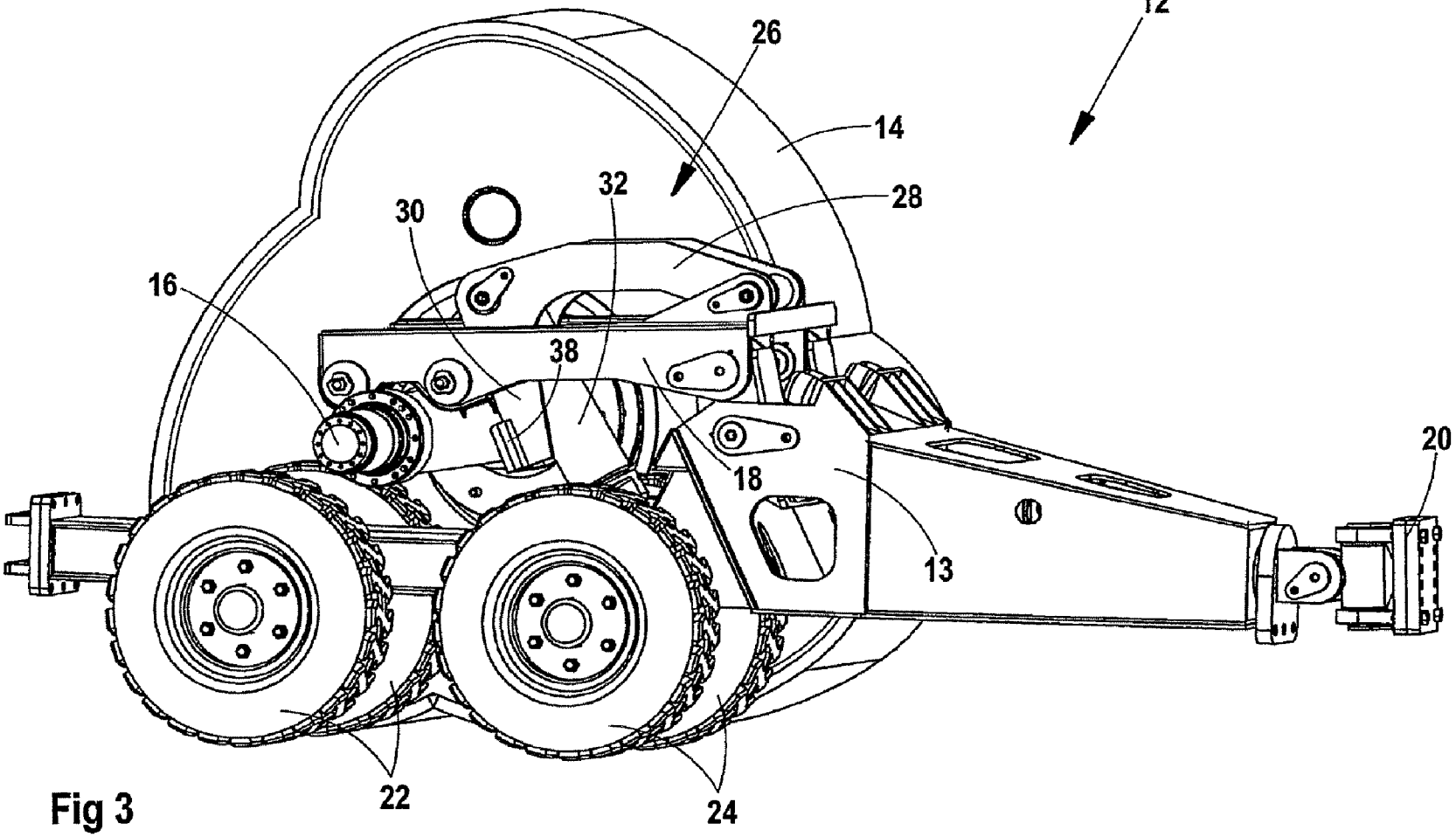
FIG. 3 shows a side view of the impact compactor of FIG. 2, having the near-side non-round roller omitted therefrom for the sake of clarity, in the same operative configuration as shown in FIG. 2.
Figure 4:
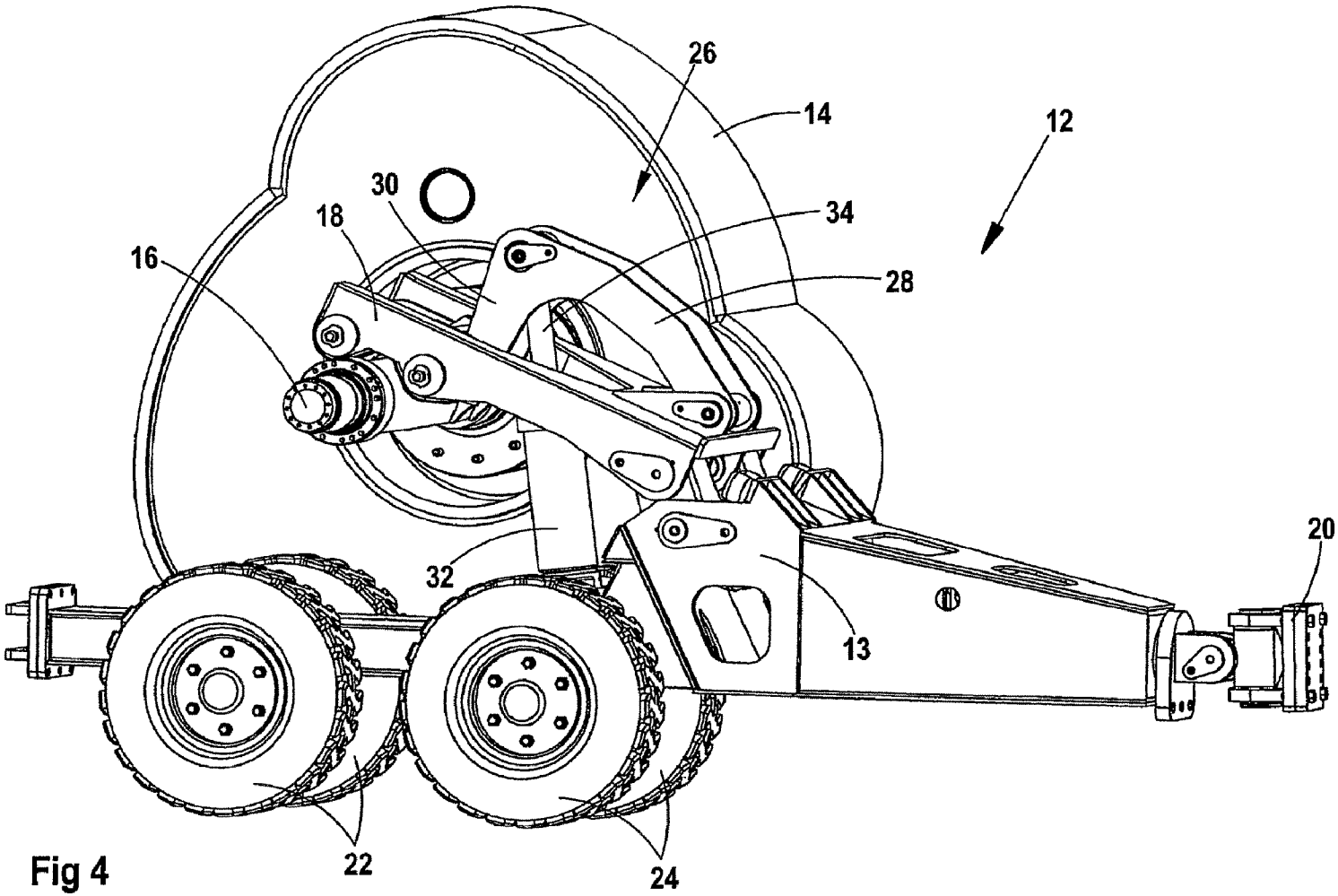
FIG. 4 shows a side view of the impact compactor as shown in FIG. 3, in an inoperative displacement configuration thereof.
Figure 5:
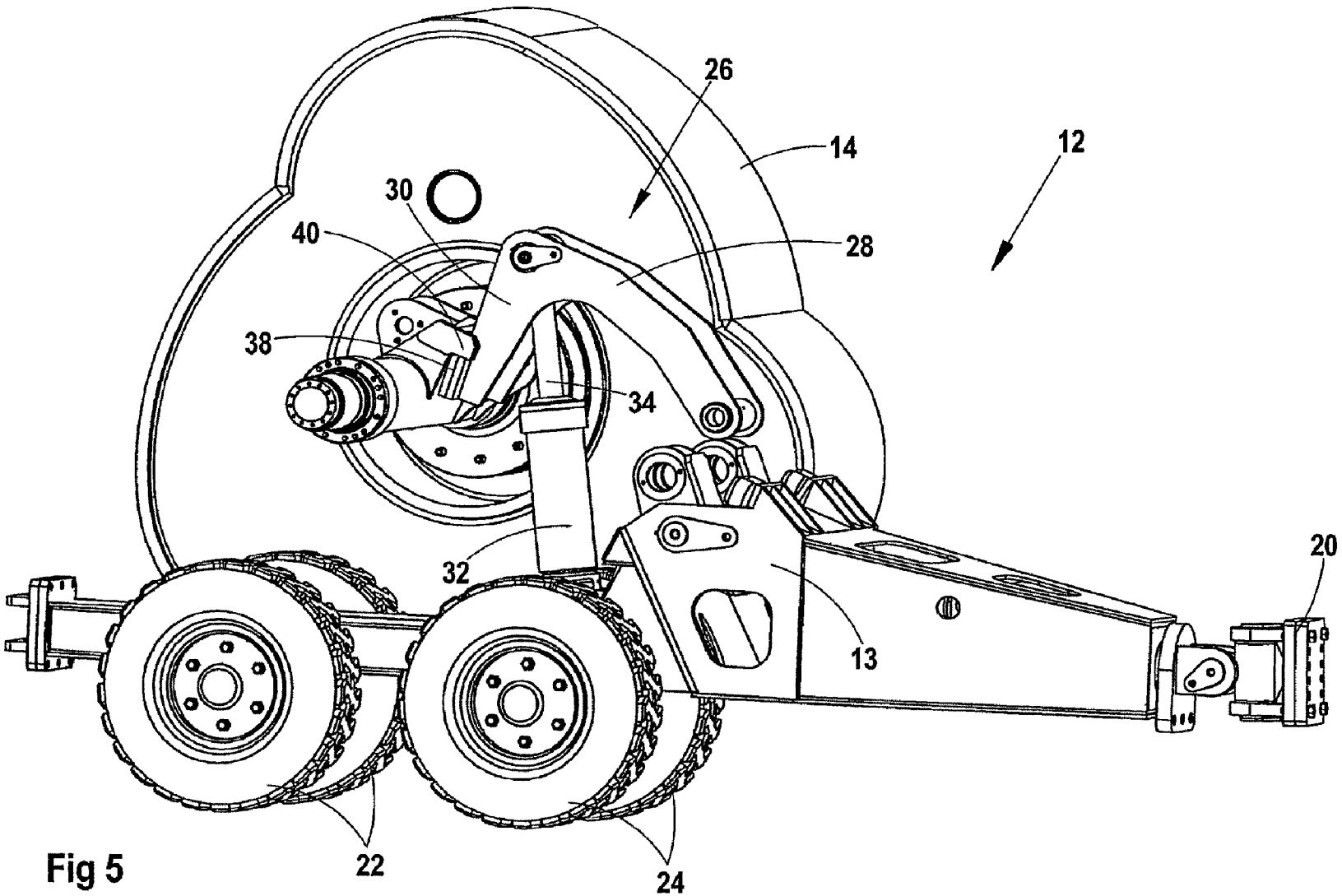
FIG. 5 shows a side view of the impact compactor as shown in FIG. 4, having the drag link thereof omitted for the sake of clarity.
Figure 6:
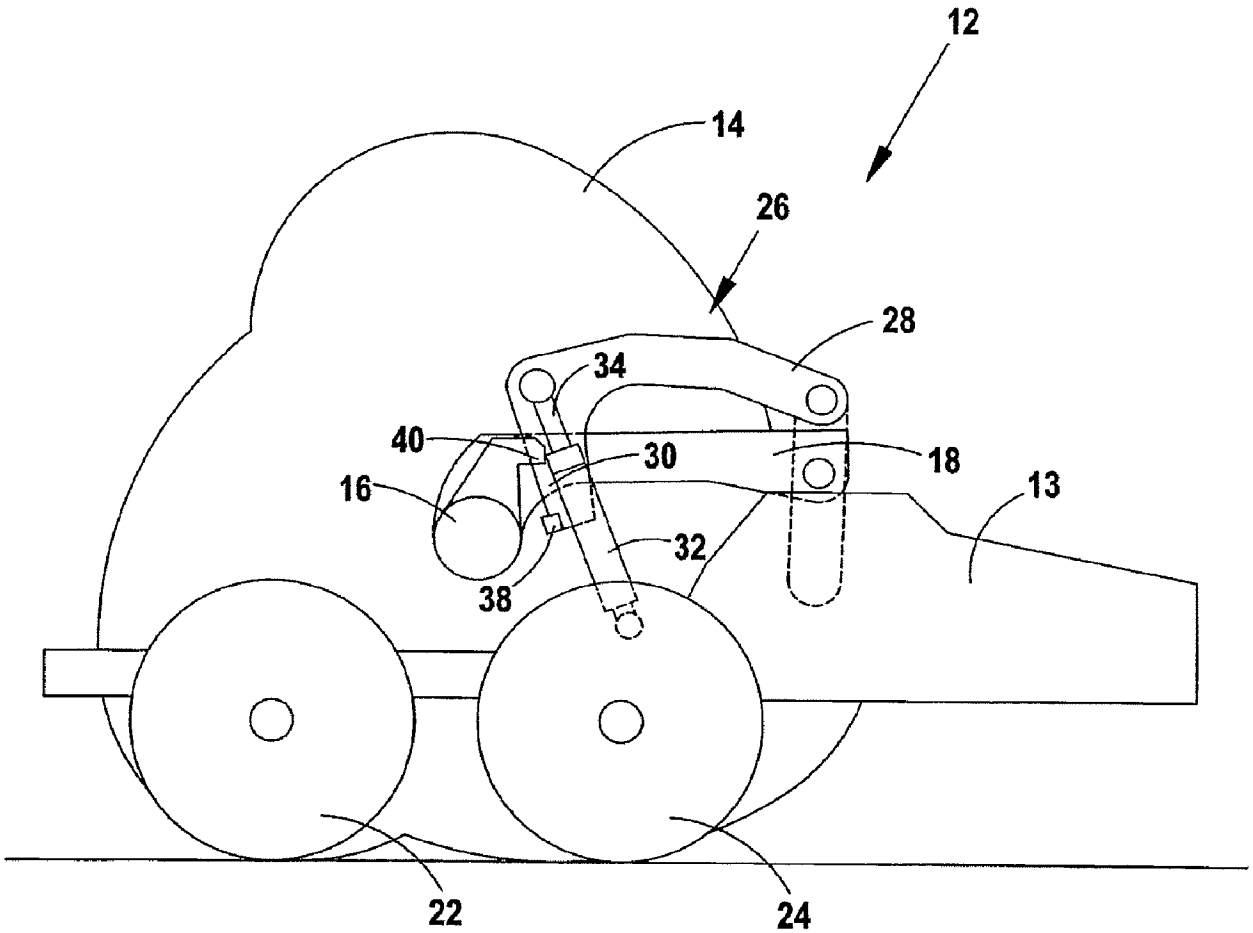
FIG. 6 shows a schematic side view of the impact compactor of FIG. 2, in its operative compactor configuration.
Figure 7:
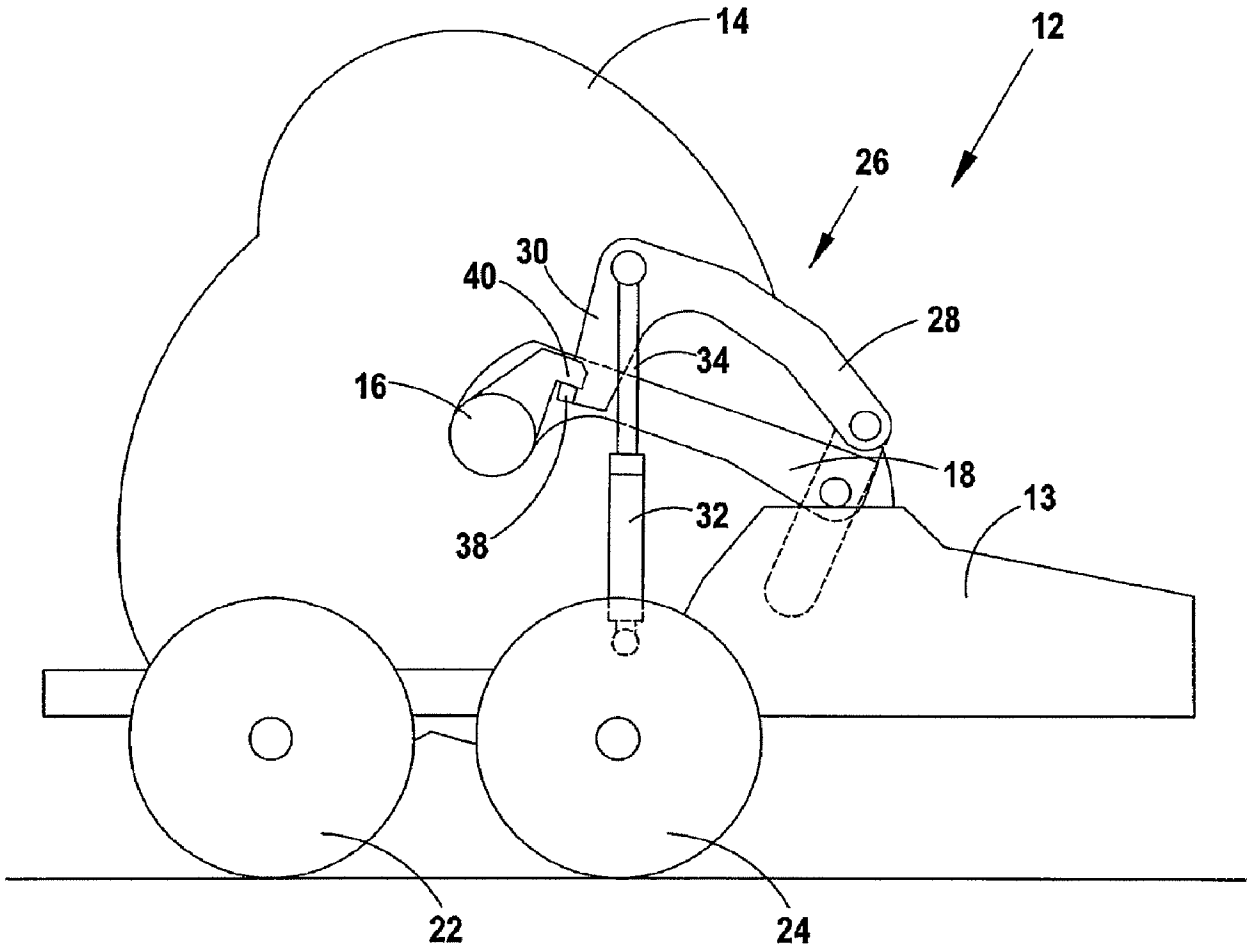
FIG. 7 shows a schematic side view of the impact compactor of FIG. 2, in its inoperative displacement configuration.

The lifting arrangement 26 particularly includes a lifting arm 28 that is pivotally mounted on the drag link 18, near the pivotally mounted end of the drag link 18, the lifting arm 28 having a lifting formation 30 depending therefrom. A piston/cylinder mechanism 32 is operable between the chassis structure 13 and the lifting arm 28, particularly at a location on the lifting arm remote from its pivotally located end, operation of the piston/cylinder mechanism providing for the pivotal displacement of the lifting arm 28 between a first position as shown in FIGS. 3 and 6 and a second position as shown in FIGS. 4, 5 and 7. In this second position, the lifting formation 30 has engaged an engagement formation 40 provided on the axle assembly 16 and through the displacement of the lifting arm has lifted the axle assembly 16, together with the drag link 18 and the non-round rollers 14, to the raised position as shown.

The piston rod 34 (see FIG. 4) of the piston/cylinder mechanism 32 particularly has its free end pivotally secured to the lifting arm 28, whereas the opposite end of the piston/cylinder mechanism 32 is pivotally supported on the chassis structure 13, particularly via a support formation (not clearly shown), which is disposed in the general plane of the chassis structure 13, particularly above the lowest side of the chassis structure 13. As is shown clearly in FIG. 6 of the drawings, with the piston/cylinder mechanism 32 in its fully retracted position, a spacing is provided between a formation 38 provided on the lifting formation 30 and the engagement formation 40 provided on the axle assembly 16, thus permitting normal operation of the impact compactor 12 for fulfilling a compacting operation, without mechanical interference with the lifting arrangement 26. By the displacement of the piston/cylinder mechanism 32 into its fully extended configuration, the formation 38 is displaced into engagement with the engagement formation 40 and hence the axle assembly 16, the non-round rollers 14, and the drag link 18 are displaced into the inoperative displacement configuration of the impact compactor, particularly as shown in FIGS. 4, 5 and 7 of the drawings.

It will be appreciated that the location of the piston/cylinder mechanism 32 where it is supported by the chassis structure 13 is sufficiently raised to ensure that ground interference cannot occur, whereas the configuration of the lifting arm 28 particularly is such that the effective stroke that is provided by the piston/cylinder mechanism 32 is such that the non-round rollers 14 can be raised to their required raised position. When in this raised position, the wheels 22 and 24 clearly carry the load of the impact compactor 12, thus facilitating the displacement of the impact compactor, when not in use.

Figure 8:
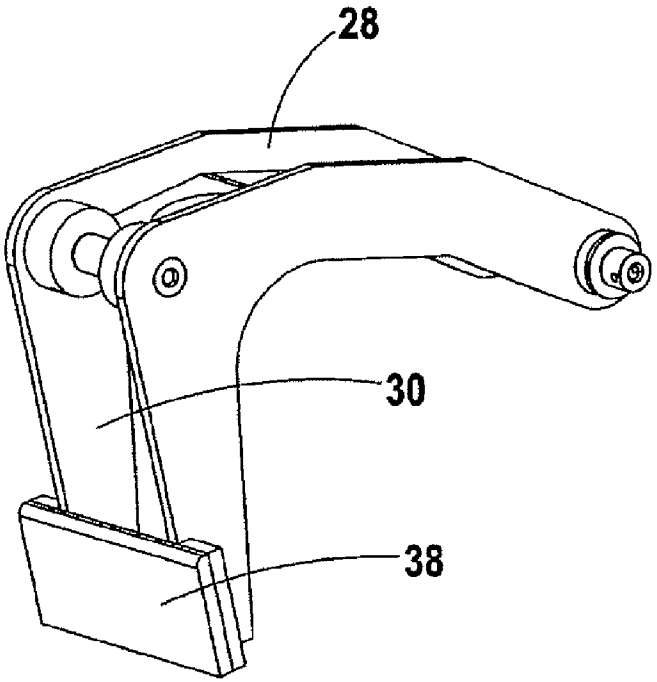
FIG. 8 shows a three-dimensional view of a part of the lifting arrangement of the impact compactor of FIG. 2.

FIG. 8 illustrates in detail the configuration of the lifting arm 28, its depending lifting formation 30, and the formation 38, which projects from the lifting formation and which engages the engagement formation 40 provided on the axle assembly 16, when the non-round rollers 14 are displaced to their inoperative raised position.

Figure 9:
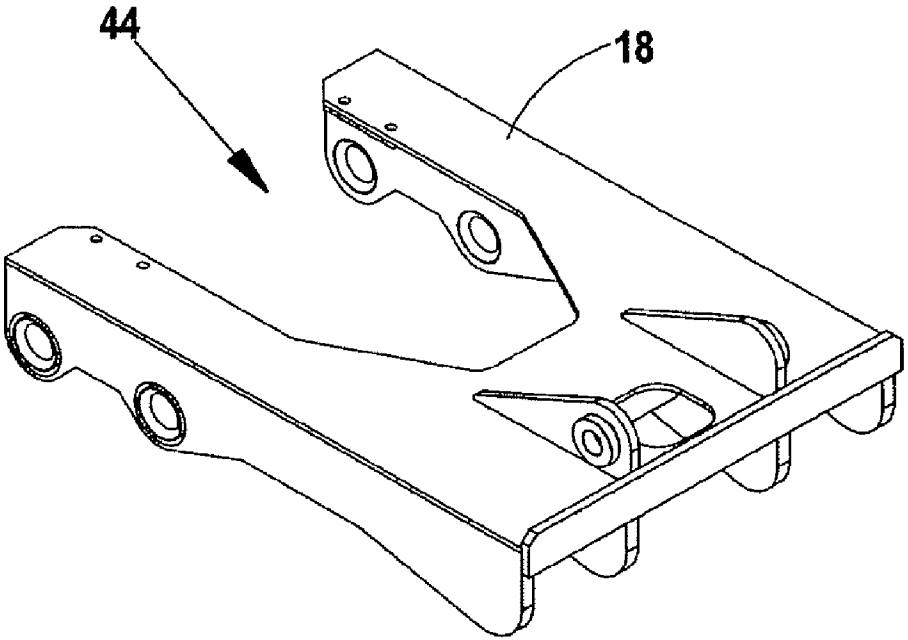
FIG. 9 shows a three-dimensional view of the drag link of the impact compactor of FIG. 2.

FIG. 9 illustrates the drag link 18 and, particularly, the pivotal location provided thereon for the lifting arm 28, as well as a space 44 which accommodates the depending lifting formation 30 of the lifting arm 28, to permit the required pivotal displacement of the lifting arm and the engagement thereof with the axle assembly 16.

It will be understood that the mechanical configuration of the impact compactor of the invention can be varied in many different respects. The invention extends also to such variations of the impact compactor of the invention, which still incorporate the essential principles of the invention as hereinabove described. One particular variation envisaged is that the lifting arm can act directly on the drag link for the displacement of the non-round rollers into their inoperative raised position, while still a further variation provides for the lifting arm to extend over and beyond the drag link and the axle assembly, to permit engagement thereof from the opposite side thereof.

It must be understood also that the same principles of the invention as applied to the impact compactor 12 also can be applied to an impact compactor having a single non-round roller, such a single non-round roller impact compactor particularly being provided with a lifting arrangement including two lifting arms, similarly disposed but on opposite sides of the non-rounded roller.

It must also be understood that the same principles of the invention as above defined can apply to a self-propelled impact compactor, clearly providing for the displacement of such a self-propelled impact compactor when not in use.

The pivotal location of the lifting arm of the lifting arrangement of the impact compactor also can be varied in various different respects insofar as it need not be pivotally mounted on the drag link as such, it being envisaged in this regard that the lifting arm may be pivotally mounted either directly on the chassis structure of the impact compactor or on the drop link carrying the drag link 18. One particular alternative embodiment of the invention provides for both the drag link and the lifting arm to be pivotally located on the same drop link that carries the drag link with respect to the chassis structure 13.

Insofar as the lifting arrangement of the impact compactor of the invention is clearly visible, the operation thereof can be easily monitored by the operator of the impact compactor and it can be particularly ensured that in the inoperative configuration of the lifting arrangement, the piston/cylinder mechanism is fully retracted, thus ensuring the required spacing between the depending lifting formation and the engagement formation engaged thereby during displacement of the lifting arm into its operative configuration. The configuration of the lifting arrangement also is such that it is relatively easily accessible for maintenance and repair purposes.

The disadvantages associated with known impact compactors in relation to the lifting arrangement thereof clearly are greatly alleviated in relation to the impact compactor of the invention, both in relation to ground clearance and clearance between the lifting arrangement and the remainder of the impact compactor, which is required to avoid mechanical damage to the lifting arrangement during operation of the impact compactor.

Figure 10:
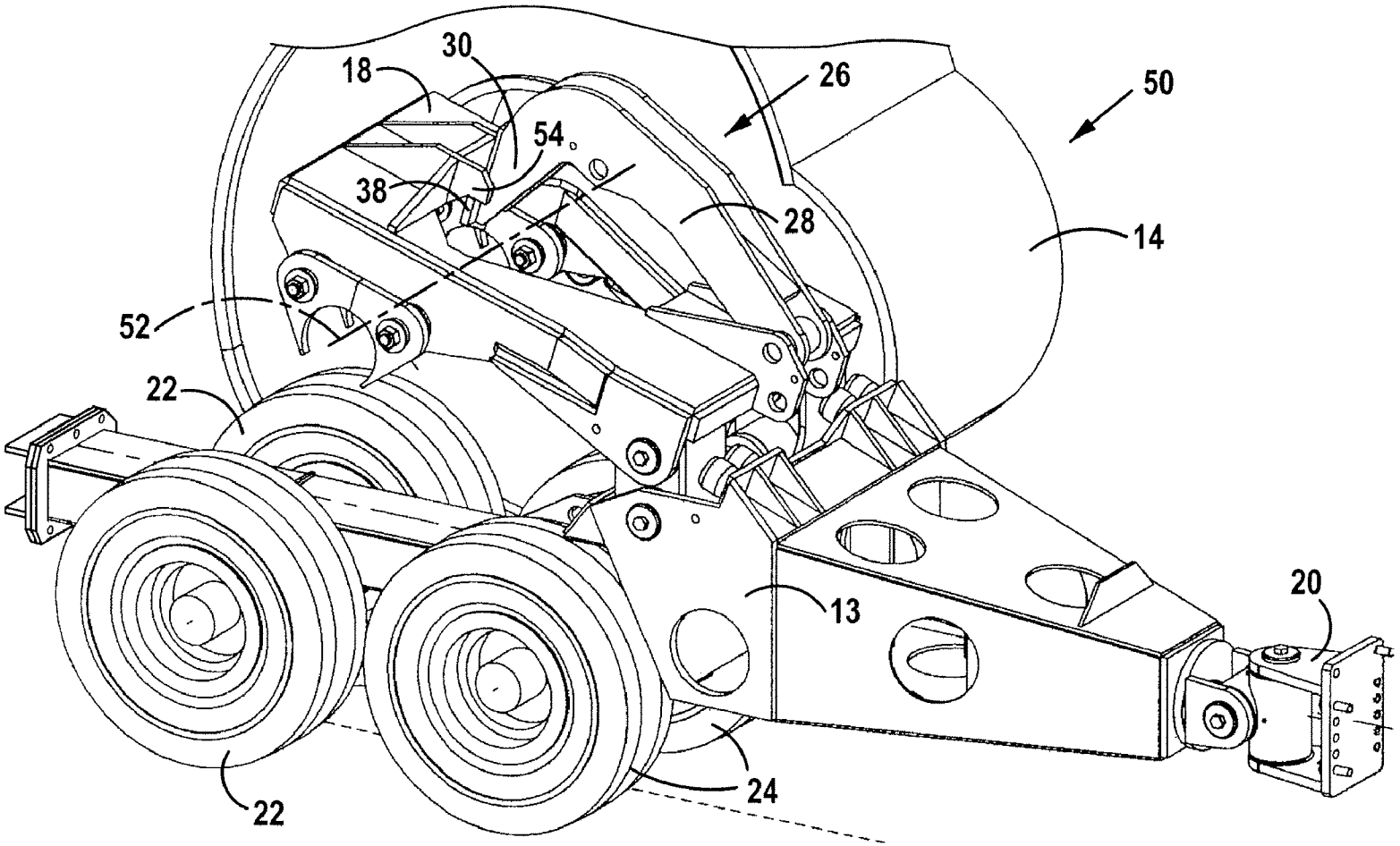
FIG. 10 shows a three-dimensional view of another impact compactor, in accordance with the invention.

Referring to FIG. 10, another impact compactor, in accordance with the invention, is designated generally by the reference numeral 50. The impact compactor 50 includes many features corresponding to features of the impact compactor 12 of FIGS. 2 to 9. Some such features are again designated by the same reference numerals as before and a description of these features is not repeated.

The impact compactor 50 has an axle assembly carrying its rollers 14 (of which only one is shown), the axle assembly not being shown but being represented by a central axis 52 thereof. The impact compactor 12 of FIGS. 2 to 9 had an engagement formation 40 provided on the axle assembly 16 and engageable with a formation 38 provided on the depending lifting formation 30. By contrast, in the impact compactor 50, the formation 38 provided on the depending lifting formation 30 is engageable with an engagement formation 54 provided on the drag link 18 and not on the depending lifting formation 30.

The invention claimed is:

1. An impact compactor, comprising:

a chassis structure having wheels for supporting the structure above the ground;

a pair of opposite non-round impact rollers carried on an axle assembly linked to the chassis structure via a pivotal drag link, the rollers being shaped to, in use, impart under their own weight a series of compaction impacts on a ground surface over which they are displaced;

an engagement formation provided on one of the drag link and the axle assembly; and a lifting arrangement for lifting the rollers with respect to the chassis structure to a raised level at which the rollers are spaced above the ground, the lifting arrangement including a lifting arm and a hydraulic piston/cylinder mechanism, in which:

the lifting arm is located above the drag link and is pivotable about a front end thereof the lifting arm has a depending lifting formation depending from a rear end of the lifting arm and defining at a bottom end thereof a formation for engaging the engagement formation;

a bottom end of the piston/cylinder mechanism is mounted to act on the chassis structure at a level below the drag link, a top end of the piston/cylinder mechanism is mounted to act on the lifting arm, and the piston/cylinder mechanism extends through a space defined through the drag link; and the piston/cylinder mechanism is operable to effect pivotal displacement of the lifting arm between a first position, in which the formation for engaging the engagement formation is at a level below and spaced from the engagement formation, and a second position, in which the formation for engaging the engagement formation is engaged with the engagement formation and the rollers are thereby raised with respect to the chassis structure to the raised level at which the rollers are spaced above the ground.

2. An impact compactor as claimed in claim 1, in which the engagement formation is provided on the drag link.

3. An impact compactor as claimed in claim 1, in which the engagement formation is provided on the axle assembly.

4. An impact compactor as claimed in claim 1, in which the piston of the piston/cylinder mechanism has a stroke that provides for the required displacement of the lifting arm between its first and second positions, the first position of the lifting arm providing for a sufficient spacing between the engagement formation and the formation for engaging the engagement formation, to permit operation of the compactor without mechanical interference between the engagement formation and the formation for engaging the engagement formation.

5. An impact compactor as claimed in claim 1, in which the depending lifting formation of the lifting arm extends through the space defined through the drag link.

6. An impact compactor as claimed in claim 1, in which the lifting arm is pivotally supported on the drag link at a location near the front end of the drag link.

7. An impact compactor as claimed in claim 1, which is configured to be towed by a tractor for its operation.

* * * * *